US008931840B2

(12) United States Patent
Huang

(10) Patent No.: US 8,931,840 B2
(45) Date of Patent: Jan. 13, 2015

(54) COMPOSITE FRAME

(71) Applicant: Yi-Chen Huang, Chiayi County (TW)

(72) Inventor: Yi-Chen Huang, Chiayi County (TW)

( * ) Notice: Subject to any disclaimer, the term of this patent is extended or adjusted under 35 U.S.C. 154(b) by 238 days.

(21) Appl. No.: 13/693,354

(22) Filed: Dec. 4, 2012

(65) Prior Publication Data

US 2014/0152063 A1 Jun. 5, 2014

(51) Int. Cl.
*A63G 9/00* (2006.01)
*A45F 3/24* (2006.01)

(52) U.S. Cl.
CPC ..... *A45F 3/24* (2013.01)
USPC ..... 297/273; 472/118; 5/127; 5/128

(58) Field of Classification Search
CPC ..... A63G 9/00; A45F 9/02; A45F 3/24
USPC ..... 297/273, 16.2; 472/118; 5/127, 128
See application file for complete search history.

(56) References Cited

U.S. PATENT DOCUMENTS

| | | | | |
|---|---|---|---|---|
| 1,229,537 | A * | 6/1917 | Sisbower et al. | 5/127 |
| 1,346,973 | A * | 7/1920 | Padden | 5/127 |
| 3,256,016 | A * | 6/1966 | Daniel | 472/118 |
| 6,019,427 | A * | 2/2000 | Combest | 297/273 |
| 6,276,008 | B1 * | 8/2001 | Chen | 5/127 |
| 6,582,018 | B2 * | 6/2003 | Tseng | 297/273 |
| 6,958,017 | B1 * | 10/2005 | Toombs, Jr. | 297/273 |
| 7,862,442 | B2 * | 1/2011 | Tseng | 297/273 |

* cited by examiner

*Primary Examiner* — Anthony D Barfield
(74) *Attorney, Agent, or Firm* — SmithAmundsen LLC; Kelly J. Smith; Dennis S. Schell

(57) ABSTRACT

A composite frame includes a frame body including two support units, two lower connecting rods, two suspending units and an upper connecting rod that are removably connectable together so that the constructed frame body is structurally stable, while assembly and disassembly of the same are manually operable and convenient to allow for effective storage and cost reduction in terms of packaging and delivery.

6 Claims, 5 Drawing Sheets

COMPOSITE FRAME

BACKGROUND OF THE INVENTION

1. Field of the Invention

The invention relates to a frame, more particularly to a composite frame.

2. Description of the Related Art

In daily life, a frame structure is needed for various purposes, such as for doing laundry, performing pull-up exercise, hanging a swing or a hammock, etc. Conventionally, such kind of frames has a fixed structure and cannot be disassembled for storage, such as the swing frame disclosed in Taiwanese Patent No. M241110, which is generally fixed to a specific spot once installed, and which requires multiple tools and consumes much time and labor to disassemble, making it rather inconvenient.

SUMMARY OF THE INVENTION

Therefore, the object of the present invention is to provide a composite frame that is easy to assemble and that can be easily stowed away.

According to the present invention, there is provided a composite frame that includes a frame body. The frame body includes two support units, two lower connecting rods, two suspending units and an upper connecting rod.

The support units are spaced apart from each other in a left-right direction, and each includes an upright rod, two leg rods, two fastening members and a limiting member.

The upright rod extends in a vertical direction transverse to the left-right direction. The two leg rods are spaced apart from each other in a front-rear direction transverse to the left-right direction and the vertical direction. Each of the leg rods is pivotably connected to the upright rod, is pivotable relative to an imaginary plane defined by the upright rods of the support units, and has a coupling section that extends in the left-right direction. The fastening members are respectively coupled to the upright rod and one of the leg rods, while the limiting member is pivotably connected to the other one of the leg rods and is operable to be pivoted relative to said other one of the leg rods to cross the upright rod and said one of the leg rods so as to be stopped by the fastening members. Each of the fastening members is operable to urge the limiting member to abut against the respective one of the upright rod and said one of the leg rods.

The lower connecting rods of the frame body are spaced apart from each other in the front-rear direction, and extend in the left-right direction. Each of the lower connecting rods has two ends that are sleevingly and respectively connectable with the coupling sections of a corresponding opposite pair of the leg rods of the support units, where the leg rods in the opposite pair are opposite to each other in the left-right direction.

The suspending units are spaced apart from each other in the left-right direction, and each has a first end that is sleevingly connectable with a top portion of the upright rod of a corresponding one of the support units and a second end that is distal from the first end.

The upper connecting rod also has two opposite ends, each of which is sleevingly connectable with the second end of a corresponding one of the suspending units.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
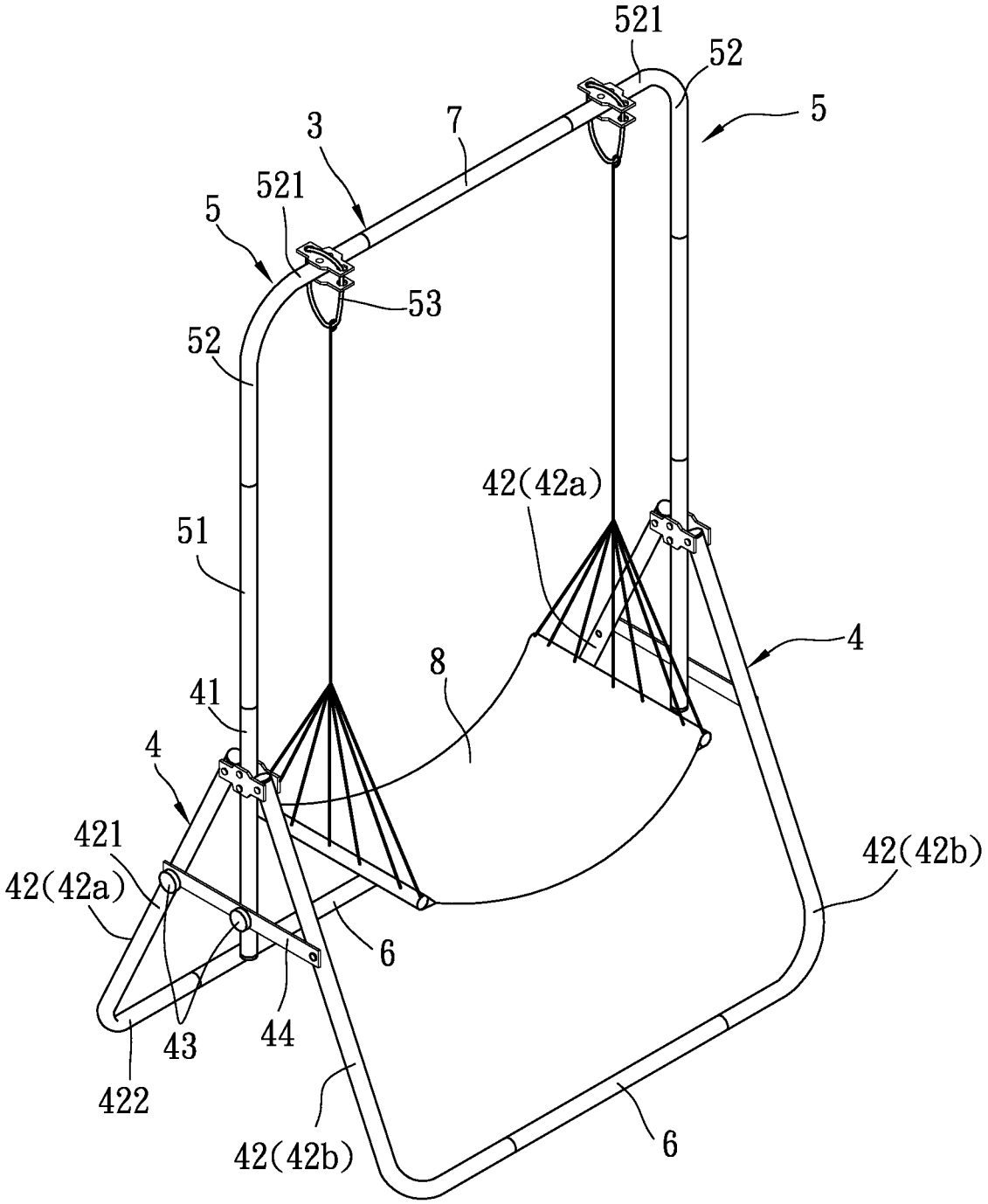
FIG. 1 is an assembled perspective view of the preferred embodiment of a composite frame according to the present invention.

As shown in FIG. 1, the preferred embodiment of a composite frame according to the present invention is shown to be placed on the ground (not shown), and comprises a frame body 3 and a swing body 8 removably and hangingly mounted on the frame body 3.

Figure 2:
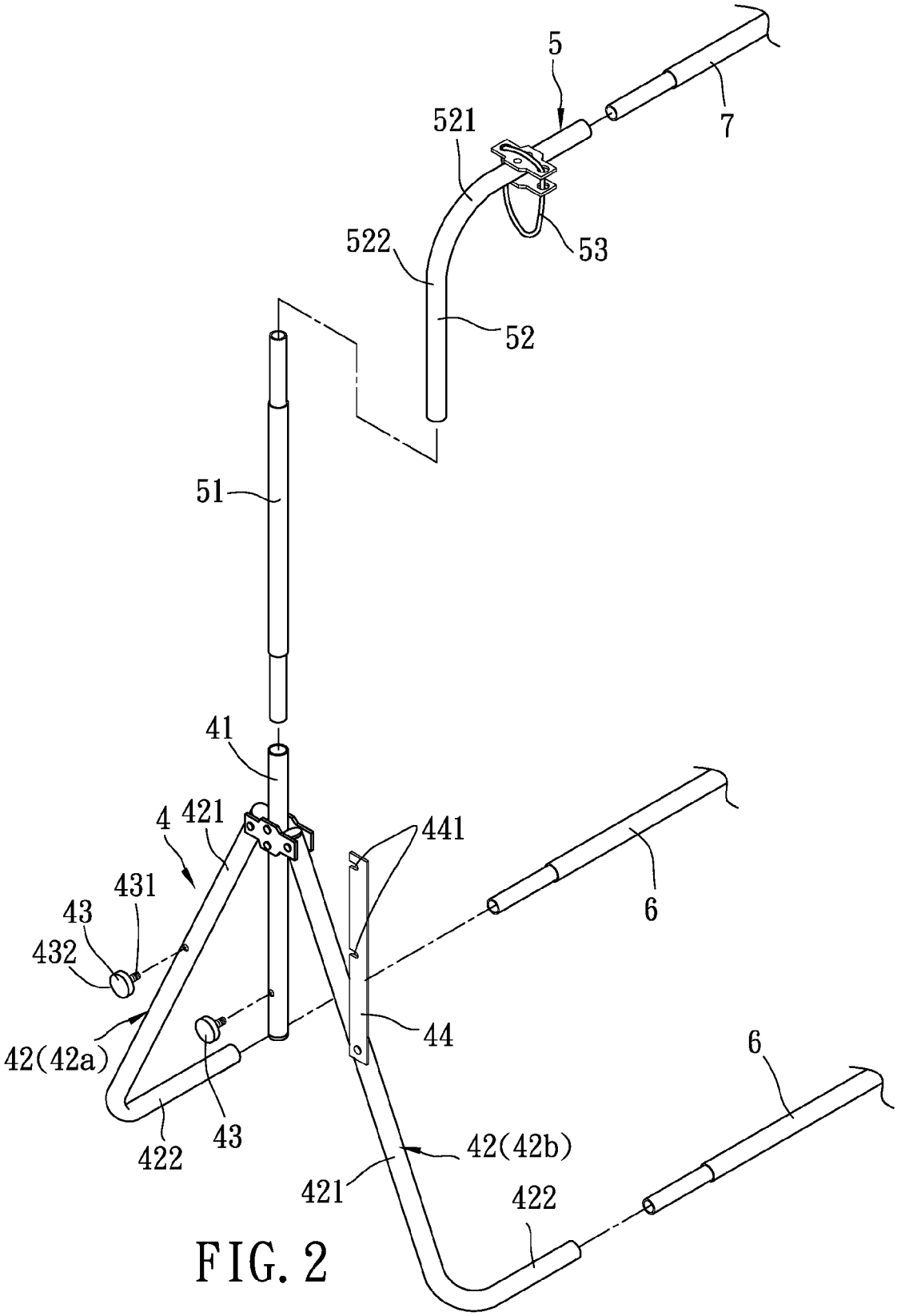
FIG. 2 is a fragmentary and partly-exploded perspective view of the preferred embodiment.
Figure 3:
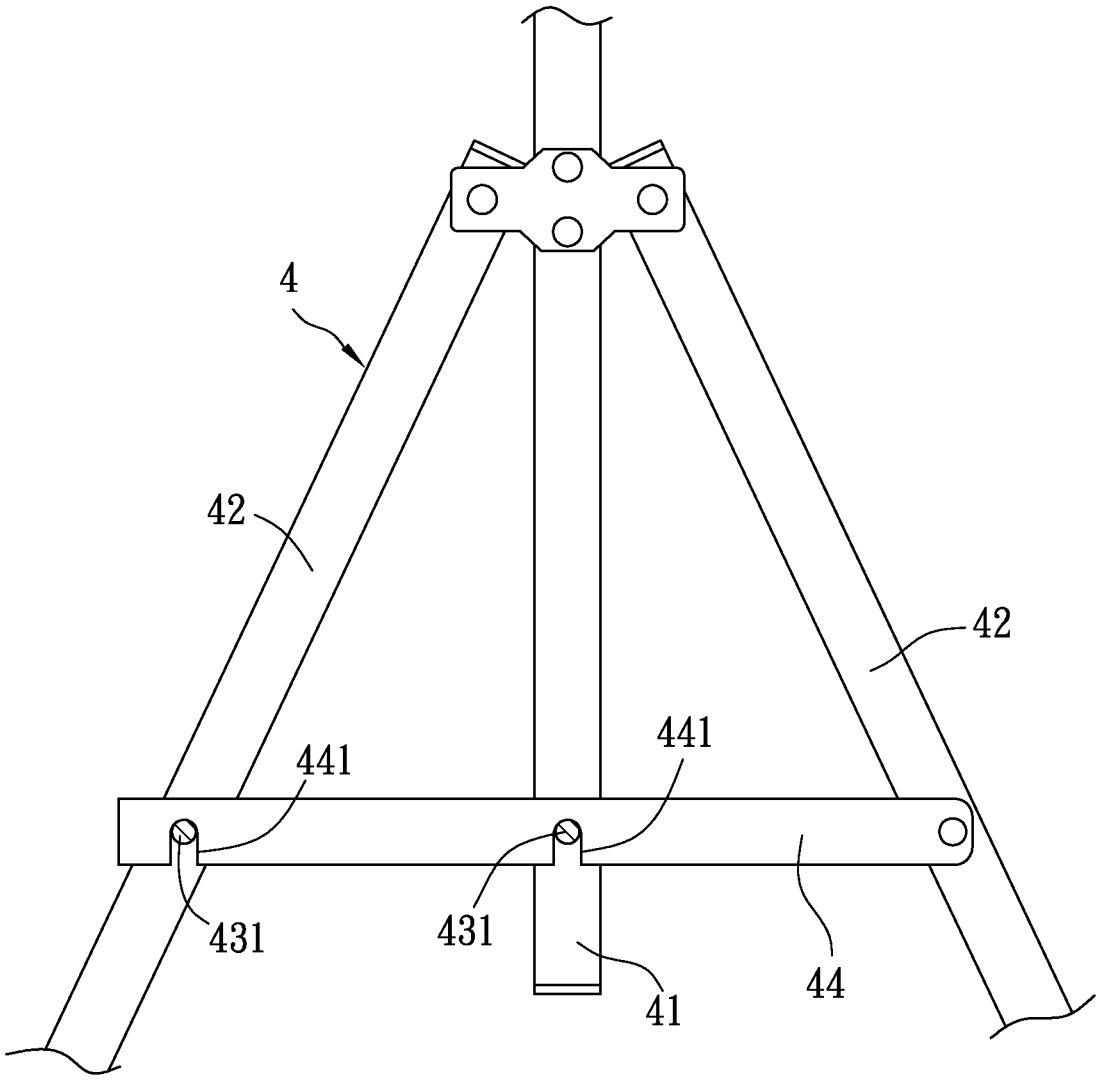
FIG. 3 is a fragmentary and partly-sectional side view from the left for illustrating one of two support units of the preferred embodiment.
Figure 4:
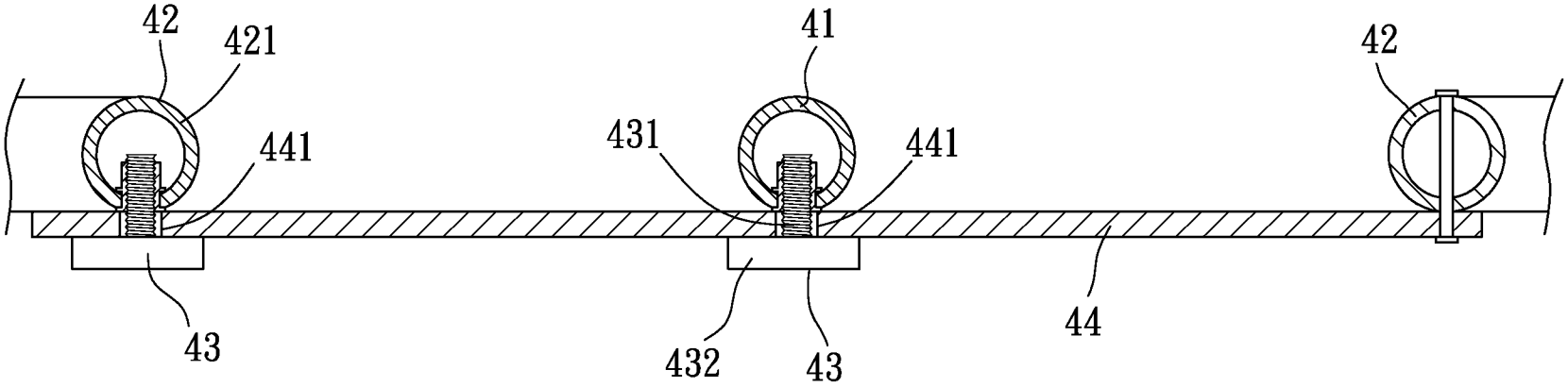
FIG. 4 is a top sectional view of the support units.

The frame body 3 includes two support units 4 spaced apart from each other in a left-right direction, two suspending units 5 spaced apart from each other in the left-right direction and respectively and sleevingly connectable with the support units 4, two lower connecting rods 6 spaced apart from each other in a front-rear direction that is transverse to the left-right direction, extending in the left-right direction and sleevingly connectable between the support units 4, and an upper connecting rod 7 extending in the left-right direction and sleevingly connectable between the suspending units 5. As shown in FIGS. 2, 3, and 4, since the composite frame is a structure of left-right symmetry, the following description will generally refer only to the left pair of the support and suspending units 4, 5 for the sake of simplicity and convenience of illustration.

Figure 5:
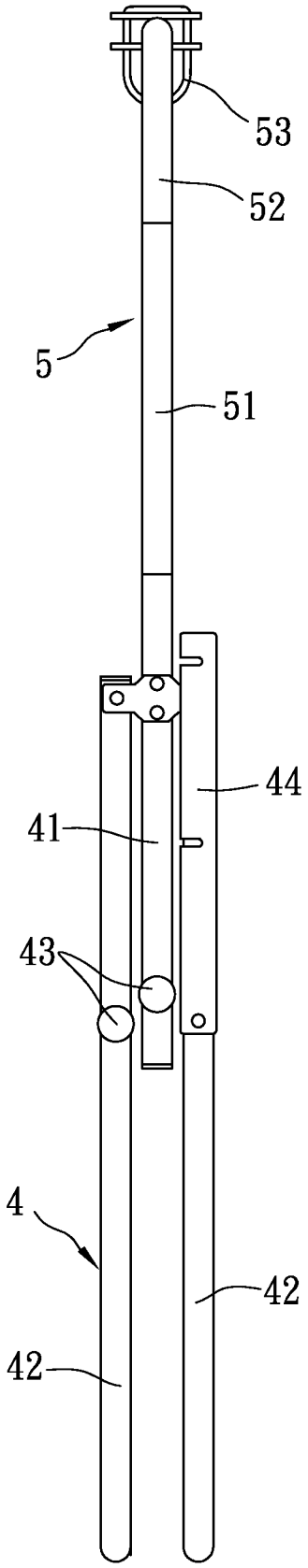
FIG. 5 is a side view from the left for illustrating the preferred embodiment in a folded state.

Each of the support units 4 includes an upright rod 41, two leg rods 42 spaced apart from each other in the front-rear direction, two fastening members 43, and a limiting member 44. Each of the leg rods 42 is pivotably connected to the upright rod 41, and is pivotable relative to an imaginary plane defined by the upright rods 41 of the support units 4 between a support position (as shown in FIG. 1) and a stored position (as shown in FIG. 5). The fastening members 43 are respectively coupled to the upright rod 41 and one of the leg rods 42 (i.e., the rear one of the leg rods 42 in this embodiment, referred to hereinafter as the rear leg rod 42*a*). The limiting member 44 is pivotably connected to the other of the leg rods 42 (i.e., the front one of the leg rods 42 in this embodiment, referred to hereinafter as the front leg rod 42*b*), and is operable to be pivoted downwardly relative to the front leg rod 42*b* to cross the upright rod 41 and the rear leg rod 42*a* so as to contact, abut against and be stopped by the fastening members 43 when the leg rods 42 are disposed at the support position.

Specifically, each of the leg rods 42 has a pivot connecting section 421 pivotably mounted to the upright rod 41 and having a length greater than that of the upright rod 41. The pivot connecting section 421 extends in a vertical direction transverse to the left-right direction and the front-rear direction, and is substantially parallel to the upright rod 41 when the leg rod 42 is disposed at the stored position, and forms an angle with the upright rod 41 when the leg rod 42 is disposed at the support position. The pivot connecting sections 421 of the two leg rods 42 cooperatively form an inverse V shape when the leg rods 42 are disposed at the support position so that the composite frame may be supported on the ground. Each of the leg rods 42 further has a coupling section 422 connected transversely to the pivot connecting section 421 and extending in the left-right direction towards the other one of the support units 4. The limiting member 44 is formed in a bottom edge thereof with two notches 441 that are spaced apart from each other. When stopped by the fastening members 43 after being pivoted downwardly to cross the upright rod 41 and the rear leg rod 42*a*, the limiting member 44 extends in the front-rear direction, and the fastening members 43 are respectively received in the notches 441.

Specifically, each of the fastening members 43 includes a stem 431 that extends through the respective one of the upright rod 41 and the rear leg rod 42*a*, and a head 432 that is connected to the stem 431. The stem 431 is receivable in the respective one of the notches 441 for limiting pivotal movement of the limiting member 44 relative to the front leg rod 42*b*, and the head 432 is operable to urge the limiting member 44 to abut against the respective one of the upright rod 41 and the rear leg rod 42*a* such that the head 432 cooperates with the respective one of the upright rod 41 and the rear leg rod 42*a* to clamp the limiting member 44 in a sandwiching manner.

As shown in FIG. 1, each of the suspending units 5 has a first end that is sleevingly connectable with a top portion of the upright rod 41 of the respective one of the support units 4 and a second end that is distal from the first end. With further reference to FIGS. 2 and 5, in this embodiment, each of the suspending units includes an extending rod 51 that extends in the vertical direction and that has the first end and a third end opposite to the first end, a suspending rod 52 that includes a horizontal segment 521 and a vertical segment 522 cooperating with each other to form a substantially L shape, and a hanging member 53 removably mounted to the suspending rod 52. In other words, the extending rod 51 is sleevingly connectable with the top portion of the upright rod 41. The horizontal segment 521 of the suspending rod 52 extends in the left-right direction and has the second end. The vertical segment 522 of the suspending rod 52 extends in the vertical direction, is connected to the horizontal segment 521 and has a fourth end distal from the second end and sleevingly connectable with the third end of the extending rod 51.

In this embodiment, the hanging member 53 is a rope ring that surrounds and is secured to the horizontal section 521 of the suspending rod 52. However, in practice, the structure of the hanging member 53 is not limited to what is disclosed herein. The hanging member 53 may as well be a ring directly formed on the suspending rod 52, or any other structure suitable for hanging an object, etc.

Each of the lower connecting rods 6 has two opposite ends that are sleevingly and respectively connectable with the coupling sections 422 of a corresponding opposite pair of the leg rods 42 of the support units 4, wherein the leg rods 42 in the opposite pair are opposite to each other in the left-right direction, i.e., one opposite pair is constituted by the rear leg rods 42*a* of the support units 4, while the other opposite pair is constituted by the front leg rods 42*b* of the support units 4. The lower connecting rods 6 are parallel to each other when connected between the respective opposite pairs of the leg rods 42. The upper connecting rod 7 has two opposite ends, each being sleevingly connectable to the second end of the horizontal segment 521 of the suspending rod 52 of a respective one of the suspending units 5.

The swing body 8 is removably and hangingly mounted on and between the hanging members 53 of the two suspending units 5, and can swing relative to the frame body 3. In this embodiment, the swing body 8 is exemplified as a hammock. However, in practice, the swing body 8 may as well be a swing seat, a cradle, a type of device that can be seated, laid on or grasped, etc.

Through the structural design of connecting two assemblies of support and suspending units 4, 5 at the bottom with two parallel lower connecting rods 6 and connecting the two assemblies of support and suspending units 4, 5 at the top with an upper connecting rod 7, the frame body 3 of the composite frame of this invention is structurally stable. Apart from offering recreational purposes with the swing body 8, in use, the composite frame of this invention may also be used with the swing body 8 removed so that the frame body 3 serves other functional purposes, for example, as a laundry rack for hanging hangers (not shown), or as a pull-up exercise rack with the horizontal segments 521 of the suspending rods 52 and the upper connecting rod 7 connected thereto cooperatively serving as a horizontal bar. This invention is thus illustrated to have multiple uses.

Referring to FIGS. 3 and 5, to store or transport the frame body 3, there are two possible ways. The first option is to first loosen the fastening members 43 from pressing against the respective limiting members 44 by operating the heads 432 of the fastening members 43 so as to allow for pivotal movement of the limiting members 44 relative to the front leg rods 42*b* to thereby disengage the notches 441 in the limiting members 44 from the stems 431 of the fastening members 43, and then to pivot the leg rods 42 towards each other from the support position (shown in FIG. 1) to the stored position (shown in FIG. 5) to be disposed parallel to the upright rods 41 so that the frame body 3 is in a folded state, can be leaned against a vertical surface such as a wall (not shown), while still being readily and easily unfoldable.

Referring to FIGS. 2, 3 and 4, the second option utilizes the sleevingly connectable structural design of the support units 4, the suspending units 5, the lower connecting rods 6 and the upper connecting rod 7. First, after the limiting members 4 are released from the fastening members 43, the extending rods 51, the suspending rods 52, the lower connecting rods 6 and the upper connecting rod 7 are disengaged, and then the leg rods 42 of each of the support units 4 are moved to the stored position such that the support unit 4 is compactly folded into a substantially L shape with the limiting member 44, the upright rod 41 and the leg rods 42 disposed parallel to one another. At this point, the support units 4, the extending rods 51, the suspending rods 52, the lower connecting rods 6 and the upper connecting rod 7 may be stacked in such a manner that the user can save a lot of storage space if the frame body 3 is to be stowed away and that the manufacturer can save a lot of packaging and delivering costs if the frame body 3 is to be transported.

Moreover, although in this embodiment, each of the suspending units 5 consists of separable extending and suspending rods 51, 52, the extending rod 51 may be omitted in other embodiments of this invention, in which case the vertical segment 522 and the horizontal segment 521 of the suspending rod 52 respectively have the first and second ends for sleevingly, removably and respectively coupling to the upright rod 41 and the upper connecting rod 7, while still forming a firm and stable frame body 3. Moreover, although embodied as a single rod in this embodiment, each of the lower connecting rods 6 and the upper connecting rod 7 may be composed by a plurality of rods in practice to serve a further purpose of rendering adjustability in terms of a distance between the assembly of the support and suspending units 4, 5 on the left and the assembly of the support and suspending units 4, 5 on the right. Therefore, this invention is not to be limited in this respect.

In summary, through the structural design of rendering the components of the frame body 3 to be sleevingly disengageable, a firm and stable frame body 3 may be easily and quickly assembled. Moreover, the frame body 3 can further be used to hang the swing body 8 so as to form a composite frame that serves multiple purposes. In addition, when the frame body 3 is to be stored, through the foldability and expandability of the structural design for the support units 4 in addition to the sleevingly disengageable design, two storage options are provided to the user for either folding the frame body 3 into a rather flat and compact structure or dismembering all separable components of the frame body 3 to save storage space, packaging and delivery costs, making this invention very convenient in use. Therefore, the purpose of this invention is served.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A composite frame comprising:

a frame body including two support units spaced apart from each other in a left-right direction, each including an upright rod extending in a vertical direction transverse to the left-right direction, two leg rods spaced apart from each other in a front-rear direction transverse to the left-right direction and the vertical direction, each of said leg rods being pivotably connected to said upright rod, being pivotable relative to an imaginary plane defined by said upright rods of said support units, and having a coupling section that extends in the left-right direction, two fastening members respectively coupled to said upright rod and one of said leg rods, and a limiting member pivotably connected to the other one of said leg rods and operable to be pivoted relative to said other one of said leg rods to cross said upright rod and said one of said leg rods so as to be stopped by said fastening members, wherein each of said fastening members is operable to urge said limiting member to abut against the respective one of said upright rod and said one of said leg rods, two lower connecting rods spaced apart from each other in the front-rear direction, extending in the left-right direction, and each having two ends that are sleevingly and respectively connectable with said coupling sections of a corresponding opposite pair of said leg rods of said support units, said leg rods in said opposite pair being opposite to each other in the left-right direction, two suspending units spaced apart from each other in the left-right direction, and each having a first end that is sleevingly connectable with a top portion of said upright rod of a corresponding one of said support units and a second end that is distal from said first end, and an upper connecting rod having two ends, each of which is sleevingly connectable with said second end of a corresponding one of said suspending units.

2. The composite frame as claimed in claim 1, wherein, for each of said support units, said limiting member is formed with two notches, and each of said fastening members includes a stem that extends through the respective one of said upright rod and said one of said leg rods and that is receivable in a corresponding one of said notches for limiting pivotal movement of said limiting member relative to said other one of said leg rods, and a head that is connected to said stem and that is operable to urge said limiting member to abut against the respective one of said upright rod and said one of said leg rods.

3. The composite frame as claimed in claim 1, wherein each of said suspending units includes an extending rod that extends in the vertical direction and that has said first end and a third end opposite to said first end, and a suspending rod that includes a horizontal segment extending in the left-right direction and having said second end, and a vertical segment extending in the vertical direction, connected to said horizontal segment and having a fourth end distal from said second end and sleevingly connectable with said third end of said extending rod.

4. The composite frame as claimed in claim 3, wherein each of said suspending units further includes a hanging member removably mounted to said suspending rod, said composite frame further comprising a swing body removably mounted between said hanging members of said suspending units.

5. The composite frame according to claim 1, wherein each of said suspending units includes a suspending rod that includes a vertical segment extending in the vertical direction and having said first end, and a horizontal segment extending in the left-right direction, connected to said vertical segment, and having said second end.

6. The composite frame as claimed in claim 5, wherein each of said suspending units further includes a hanging member removably mounted to said suspending rod, said composite frame further comprising a swing body removably mounted between said hanging members of said suspending units.

* * * * *